United States Patent [19]

Danin

[11] Patent Number: 4,827,648

[45] Date of Patent: May 9, 1989

[54] FRAME

[76] Inventor: Colin Danin, 14 Homestead Road, Bedfordview, Transvaal, South Africa, 2008

[21] Appl. No.: 75,036

[22] Filed: Jul. 17, 1987

[30] Foreign Application Priority Data

Jul. 22, 1986 [ZA] South Africa ..... 86/5442

[51] Int. Cl.[4] ..... G09F 1/12
[52] U.S. Cl. ..... 40/154; 40/152
[58] Field of Search ..... 40/152, 154

[56] References Cited

U.S. PATENT DOCUMENTS 4,428,135 1/1984 Sobel ..... 40/152 X
4,662,092 5/1987 Kim ..... 40/152 X
4,729,183 3/1988 Tarter et al. ..... 40/152

FOREIGN PATENT DOCUMENTS 647309 7/1928 France ..... 40/152

*Primary Examiner*—A. Michael Chambers
*Assistant Examiner*—John C. Fox
*Attorney, Agent, or Firm*—Wenderoth, Lind & Ponack

[57] ABSTRACT

A frame includes four corner pieces and four side members. Each corner piece is formed with two tubular formations which are at right angles to each other and which have longitudinally extending slots in their respective walls. The side members have formations and which are complementary in shape to the tubular formations and which are frictionally engageable therewith. The opposed ends of each side member are engaged with two corner pieces respectively whereby a square or rectangular frame is constructed for a planar member with peripheral portions of the planar member being located in longitudinally extending openings in the side members respectively.

3 Claims, 3 Drawing Sheets

FRAME

BACKGROUND OF THE INVENTION

This invention relates to a frame suitable for framing a planar member, or an assembly of planar members, such as, for example, a picture which may include a backing member and a glass cover.

SUMMARY OF THE INVENTION

The invention provides a frame for at least one planar member and includes four components of a first kind, and four components of a second kind, each component of the first kind including at least one tubular formation with a longitudinally extending slot in a wall thereof, the width of the slot being less than the maximum transverse dimension of the interior of the tubular formation, each component of the second kind having at least one formation which is complementary in shape to at least a portion of the tubular formation and which is inserted into, and frictionally engaged with, the said portion of the tubular formation, and opposed ends of each component of the first kind being engaged with two components of the second kind respectively, whereby a square or rectangular frame is constructed for the planar member.

In one form of the invention, each component of the first kind is a corner piece which includes two substantially identical side portions which are disposed at right angles to each other with each side portion including one of the tubular formations.

Each corner piece may include a bridging piece which extends between the two side portions, and means engaged with the bridging piece which is adapted to bear on an underside of the planar member.

With this form of the invention, each component of the second kind is a side member and may have a longitudinally extending opening which faces inwardly and which receives a peripheral portion of the planar member.

In a variation of the invention each side portion of each corner piece include a socket-like cover member which receives and obscures at least an end portion of a respective side member, the cover member having a longitudinally extending and inwardly facing opening which is superimposed on a section of the longitudinally extending opening of the side member.

Preferably each side portion of each corner piece has a longitudinally extending surface which is inclined slightly relatively to the longitudinal axis of the side portion, and the respective side member has a surface which is substantially parallel to the longitudinal axis of the side portion, the two surfaces interengaging frictionally to an increasing extent as the side member is engaged with the corner piece.

The frame may be suspended from a flexible member which is secured to at least two hangers which are engaged respectively with two opposed side members, each hanger, at least in part, having a cross sectional shape which is substantially the same as the cross sectional shape of the said tubular formation and being slidably engaged with the said complementary formation of the respective side member.

In a second form of the invention each component of the first kind is a corner piece which includes two substantially identical side portions which are disposed at right angles to each other with each side portion including one of the tubular formations, and each component of the second kind is a side member which has a longitudinally extending opening which receives a peripheral portion of the planar member, each tubular formation of each corner piece forming a socket-like cover member which receives and obscures at least an end portion of a respective side member with the longitudinally extending slot of the tubular formation being superimposed on a section of the longitudinally extending opening of the respective side member.

In a third form of the invention each component of the first kind is a side member, and each component of the second kind is a corner piece which includes two substantially identical side portions which are disposed at right angles to each other with each side portion including one of the said complementary formations, the longitudinally extending slots of the side members receiving respective peripheral portions of the planar member.

Each side member may have an inner, longitudinally extending reinforcing formation.

It is to be noted that the corner pieces and the side members may also be adhesively fixed to one another.

The corner pieces and side members can be made from any suitable material and preferably are made from a plastics material. The corner pieces may be moulded and the side members may be extruded.

BRIEF DESCRIPTION OF THE DRAWINGS

The invention is further described by way of examples with reference to the accompanying drawings in which.

DESCRIPTION OF PREFERRED EMBODIMENTS

Figure 1:
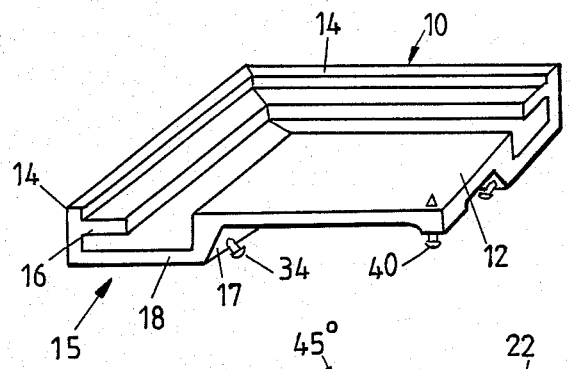
FIGS. 1 and 2 illustrate one example of the invention.
Figure 2:
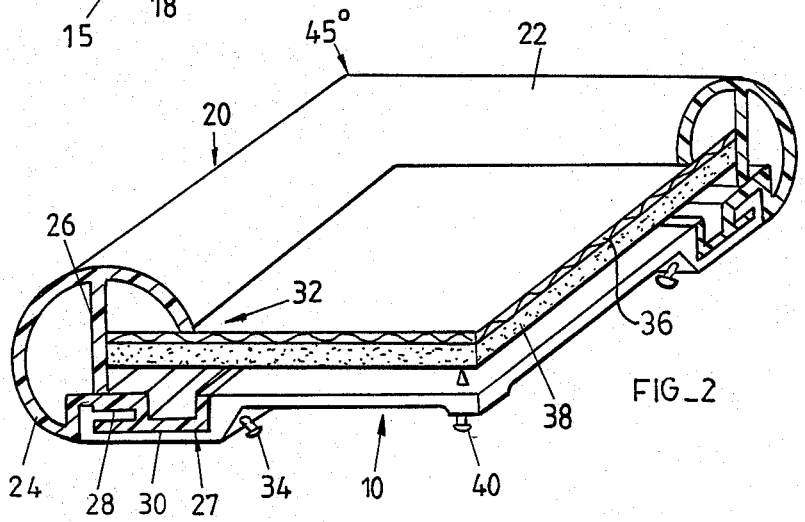

FIGS. 1 and 2 illustrate a corner piece 10 which includes a bridging piece 12, in the form of a plate, extending between two substantially identical side portions 14, disposed at right angles to each other. Each side portion 14 has a tubular formation 15 comprising a longitudinal inwardly-extending formation 16, in this case a flange, on an outer side wall, an opposed inner side wall 17, and a base 18. The flange 16 and the wall 17 define a longitudinally extending slot the width of which is less than the maximum transverse dimension of the interior of the tubular formation 15.

A picture frame is made up from four corner pieces, and two side members 20 and two side members 22, see FIG. 2, which shows a corner of a frame, in perspective. The other corners of the frame have a similar construction, and hence are not illustrated.

Each of the side members 20 and 22 is formed with a three-quarter round portion 24 which is internally braced by means of a formation 26, and which, at its lower end, includes a longitudinally extending formation 27, which is complementary in shape to the tubular formation 15 of a corner piece, and which is frictionally engageable therewith.

The formation 27 includes an undercut channel 28 and a flat outer surface 30.

The side members 20 and 22 include longitudinal openings 32, which face inwardly, and which receive peripheral portions of a picture assembly which includes glass 36 and a backing member 38 with a picture sandwiched therebetween.

The side members are kept secured to the corner piece by frictional forces and, additionally, by means of fixing screws 34. The picture frame can additionally, or alternatively, be fixed together by means of adhesive between the corner pieces and side members.

The picture assembly is biased forwardly in the frame by means of screws 40 which project from the plates 12 on to the underside of the backing member 38. The plates 12 although preferred, are not essential, as will become apparent hereinafter with reference to FIG. 6.

The relatively narrow slots in the tubular formations have the effect of an undercut construction, and ensure that the components of the frame are tightly secured to each other.

In FIGS. 3 and 4 use is again made of a corner piece 10 and side members 20 and 22. The corner piece in this instance includes a cover member 42 which defines sockets 44 which receive and obscure end portions of the respective side members. In this embodiment the corner piece 10 has two dovetail shaped ribs 46, in place of the flanges 16 shown in FIGS. 1 and 2, which narrow progressively towards the junction of the side portions. The ribs 46 thus present surfaces which are inclined to the respective longitudinal axes of the side portions. The side members have complementary undercut channels 48 which are frictionally engageable with the ribs 46. The channels 48, on the other hand, are substantially parallel to the respective longitudinal axes of the side portions. As the side members are pushed home into the cover member the frictional force between the components increases due to the varying dimensions of the ribs 46. In this way a secure frictional interengagement of the components is achieved.

Figure 5:
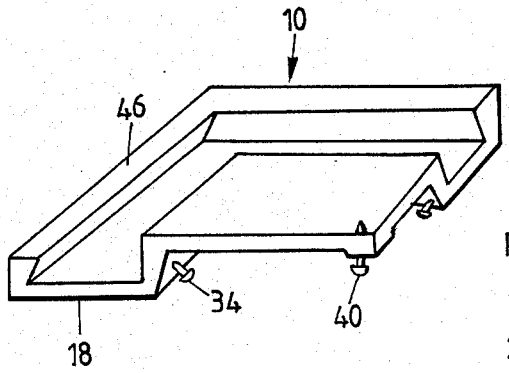
FIGS. 5 and 6 illustrate a third embodiment of the invention.
Figure 6:
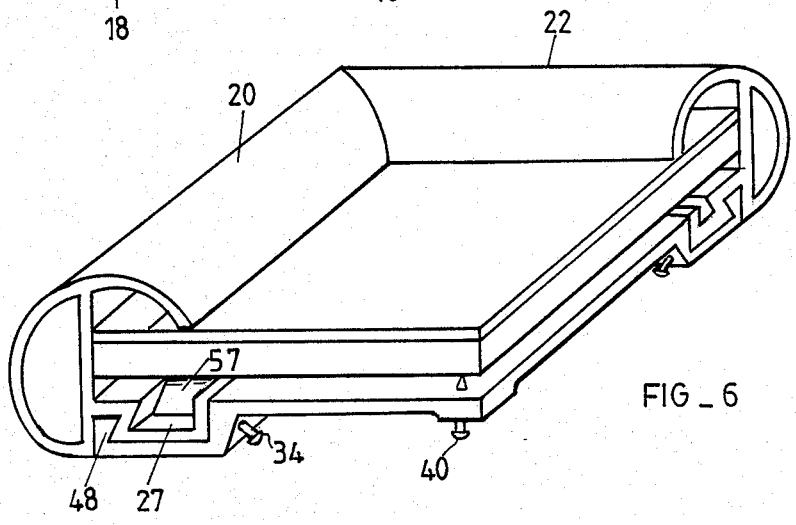

Each of the side members includes an upstanding wall 52 (i.e. the inner wall of the longitudinally extending complementary formation hereinbefore referred to) which receives hangers 50 which in turn are fixed to a cord 54. This enables the framed picture to be suspended as shown in FIG. 4. The fixing holes in the hangers 50 are off centre so that as the weight of the picture is taken by the cord the hangers tend to rotate and a frictional lock occurs. In an alternative, and preferred, form of construction of the hangers, each hanger has the same cross sectional shape as the shape of the complementary tubular formation 15 of the respective corner piece. Thus, for the embodiment of FIGS. 1 and 2, the hanger has the cross sectional shape denoted 15 and shown in FIG. 1, while, in the embodiment of FIG. 3, the hanger has a rib which is complementary to the shape of the channel 48, and which is slidably engaged therewith, and a section which comes inwardly and extends upwardly adjacent the wall 52. FIGS. 5 and 6 illustrate a variation of the invention which is similar to the arrangement of FIGS. 3 and 4, with the cover member 42 omitted. In this embodiment of the invention a bow spring 57 could be located inside the formation 27 to bias the backing member, picture and glass upwardly against the side members 20 and 22. The bridging piece 12 can be retained, or dispensed with.

Figure 7:
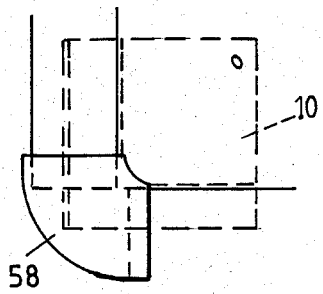
FIGS. 7 to 9 respectively illustrate other forms of the invention.
Figure 8:
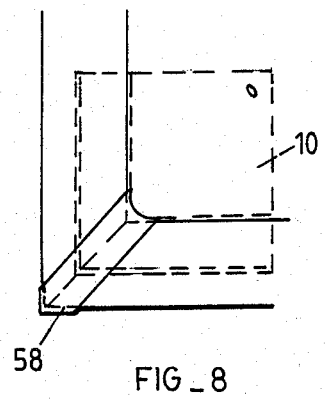
Figure 9:
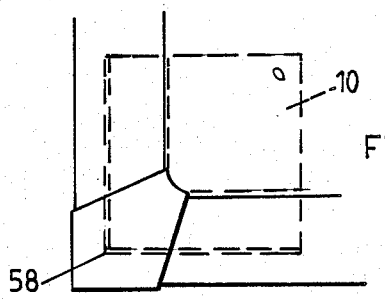

In FIGS. 7, 8 and 9 the corner piece 10 in each instance includes a cover member designated 58 which covers the junction between adjacent side members. These figures illustrate various possible shapes for the cover pieces which define sockets of different shapes and sizes for the side members.

Figure 10:
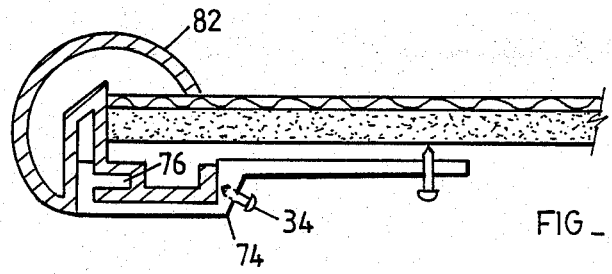
FIGS. 10 and 11 respectively illustrate two more variations of the invention.

In FIG. 10 a corner piece 74 has a construction similar to that shown in FIG. 1. In this case the corresponding side member has a three-quarter round portion 82 and is internally stiffened by means of a folded portion 76 which at the same time defines the said complementary formation which engages with the tubular formations respectively of the corner pieces. The assembly is kept together by means of locking screws 34.

Figure 11:
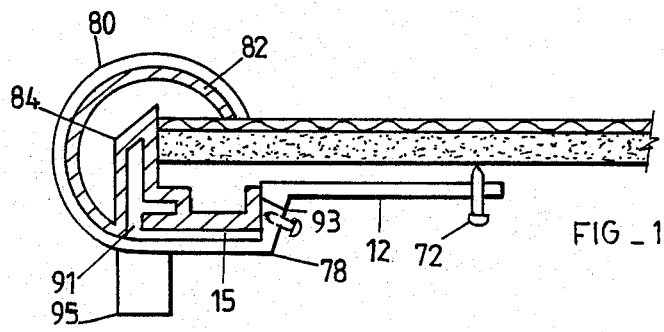

In the construction of FIG. 11 the corner piece 78 forms quarter round portions 80 which act as sockets for the correspondingly shaped side members 82, respectively. Each side member is internally stiffened by means of formations 84 similar to that shown in FIG. 10. Again the picture assembly is biased upwardly in the frame by means of a backing screw 72.

Clearly the invention can be embodied in side members and corner pieces of a variety of shapes and sizes without departing from the principles hereinbefore described. Such variations are all intended to fall within the scope of the present invention.

Two important variations are the following:

Refer in the first instance to FIG. 11. If the upstanding section 91 of the corner piece is omitted then the socket 80, in addition to being a cover for the side member, forms a tubular formation which is, in all respects, the equivalent of the tubular formation 15. It firmly engages frictionally with the side member and, due to the interengagement of the complementary shapes, unwanted relative movement of the components is eliminated. Of course, in the FIG. 11 embodiment, the socket 80 and the tubular formation 15 are both present in the corner piece. In the variation referred to, on the other hand, the socket 80 acts at the same time as the tubular formation, and as a cover for one end of a side member.

The second variation may also be explained with reference to FIG. 11 which, it is repeated, shows an embodiment wherein the corner piece has a socket 80 which surrounds the side member 82. Assume that the bridging piece 12 is severed at the line 93 and is omitted, and that the side member, in fact, has the shape of the socket 80, while side portions of the corner piece each have the shape of the side member 82. In other words the cross sectional shapes of the components are interchanged. It is apparent that the side portions of the corner piece, which now have the shape designated by the numerals 82 and 84, firmly engage frictionally with the respective side members which each now have the tubular cross sectional shape of the socket 80. A suitable bridging piece could still be formed on the corner piece, as before.

In other words, in the construction of the frame of the invention, and in the manner described, the cross-sectional shapes of the operative parts of the side members and of the corner pieces can be interchanged.

The invention has been described with reference to a frame for a picture or a picture assembly. It is of course not confined to this application and other planar members could be framed in a similar way.

Figure 3:
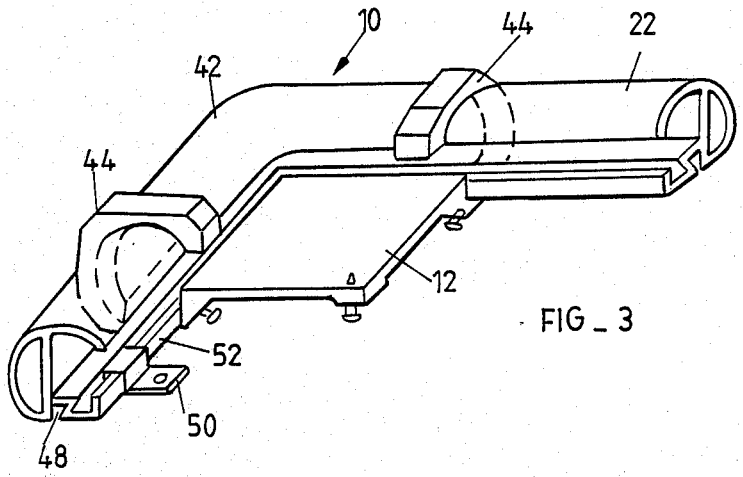
FIGS. 3 and 4 illustrate a variation of the invention.
Figure 4:
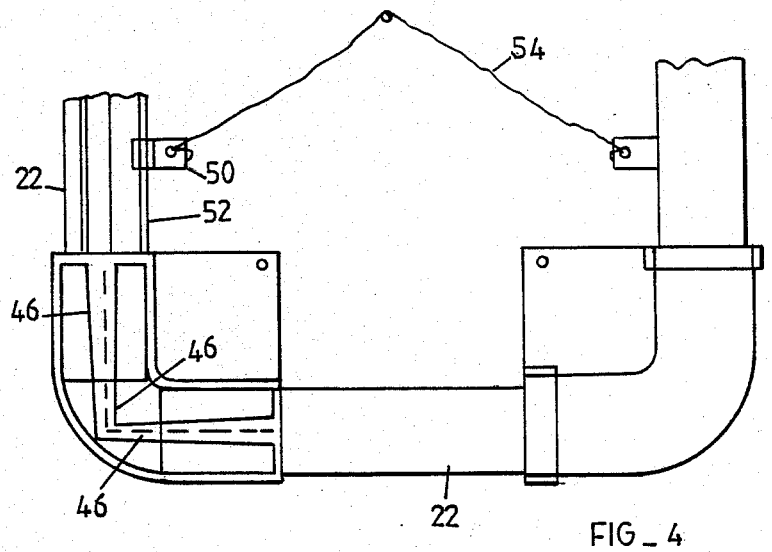

If the frame of the invention is not to be hung, then the hangers referred to with reference to FIGS. 3 or 4 can be omitted. A short spigot, or other suitable projection 95, see FIG. 11, can be formed on or secured to each of at least two corner pieces at a suitable inclination to the plane of the frame. When the frame is placed on a flat surface, in a vertical or inclined orientation, the lowermost side member rest on the flat surface and the two projections 95, which also contact the flat surface, stabilise the frame and prevent it from toppling over.

I claim:

1. A frame for at least one planar member, said frame comprising:

four corner pieces and four side members to be assembled into a rectangular configuration;

each said corner piece including two side portions which are disposed at right angles to each other, each said side portion including a tapered longitudinally extending formation, and a bridging piece which extends between said two side portions;

each said side member including a longitudinally extending slot, and a longitudinally extending formation which is engageable with the said tapered longitudinally extending formation of a respective said corner piece thereby frictionally to secure opposite ends of said side member to respective said corner pieces;

said side members adapted to be paired with said longitudinally extending slots of each pair of side members opposing one another for receiving peripheral portions of the planar member; and each said bridging piece having adjustment means for bearing on an underside of the planar member thereby to bias the planar member away from said bridging pieces.

2. A frame according to claim 1, wherein each said side portion of each said corner piece includes a socket-like cover member which receives and obscures at least an end portion of a respective said side member, each said cover member having a longitudinally extending opening which overlies a section of said longitudinally extending slot of the respective said side member so that a peripheral portion of the planar member can pass into said slot.

3. A frame according to claim 1, further comprising at least two hangers engaged respectively with two opposed said side members which, in use, extend substantially vertically, each said hangar being slidably engaged with its respective side member and including a fixing formation for a cord to extend between said hangars, said fixing formations being so positioned that when the frame is suspended from the cord, each said hangar tends to rotate relatively to its respective side member and thereby is frictionally locked thereto.

* * * * *